US006435093B1

(12) United States Patent
Yamada et al.

(10) Patent No.: US 6,435,093 B1
(45) Date of Patent: Aug. 20, 2002

(54) PRINTING APPARATUS FOR DETECTING AND CONTROLLING AN AMOUNT OF INK SOLVENT IMPREGNATED INTO A BLANKET

(75) Inventors: Shuji Yamada, Atsugi; Satoko Midorikawa, Machida, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/399,813

(22) Filed: Sep. 21, 1999

(30) Foreign Application Priority Data

Sep. 21, 1998 (JP) ..... 10-266661

(51) Int. Cl.[7] ..... B41F 13/193
(52) U.S. Cl. ..... 101/484; 101/217
(58) Field of Search ..... 101/36, 129, 217, 101/425, 484, 492, DIG. 45

(56) References Cited

U.S. PATENT DOCUMENTS

| | | | | |
|---|---|---|---|---|
| 3,965,735 A | * | 6/1976 | Hartung | 101/216 |
| 4,558,216 A | * | 12/1985 | Rodi et al. | 101/142 |
| 4,966,074 A | * | 10/1990 | Aldrich, Jr. | 101/228 |
| 5,066,883 A | | 11/1991 | Yoshioka et al. | 313/309 |
| 5,174,925 A | * | 12/1992 | Fuji et al. | 252/514 |
| 5,264,289 A | * | 11/1993 | Kondo et al. | 101/401 |
| 5,312,643 A | * | 5/1994 | Yamamoto et al. | 427/108 |
| 5,456,169 A | * | 10/1995 | Rohwetter et al. | 101/217 |
| 6,041,706 A | * | 3/2000 | Murray | 101/217 |

FOREIGN PATENT DOCUMENTS

| | | | |
|---|---|---|---|
| JP | 4-290295 | | 10/1992 |
| JP | 7-156523 | | 6/1995 |
| JP | 8-48070 | | 2/1996 |
| JP | 9-223457 | * | 8/1997 |

OTHER PUBLICATIONS

M.I. Elinson et al., "The Emission of Hot Electrons and the Field Emission of Electrons from Tin Oxide," Radio Engineering and Electronic Physics, No. 10, pp. 1290–1296, Jul. 1965.

G. Dittmer, "Electrical Conduction and Electron Emission of Discontinuous Thin Films," Thin Solid Films, No. 9, pp. 317–328, 1972.

M. Hartwell et al., "Strong Electron Emission From Patterned Tin–Indium Oxide Thin Films," International Electron Devices Meeting Technical Digest, pp. 519–521, 1975.

Araki et al., "Electroforming and Electron Emission of Carbon Thin Films," Journal of the Vacuum Society of Japan, vol. 26, No. 1, pp. 22–29, 1983.

* cited by examiner

*Primary Examiner*—Stephen R. Funk
(74) *Attorney, Agent, or Firm*—Fitzpatrick, Cella, Harper & Scinto

(57) ABSTRACT

The present invention provides an offset printing apparatus for transferring an ink pattern onto a medium to be printed through a blanket. The apparatus includes a detector for detecting an amount of ink solvent impregnated into the blanket.

28 Claims, 9 Drawing Sheets

PRINTING APPARATUS FOR DETECTING AND CONTROLLING AN AMOUNT OF INK SOLVENT IMPREGNATED INTO A BLANKET

BACKGROUND OF THE INVENTION

1. Field of the Invention

The present invention relates to a printing apparatus, and a method for manufacturing a print substrate, an electron source and an image displaying device using such a printing apparatus, and more particularly, it relates to a print substrate, an electron source and an image displaying device using such a printing apparatus, in which poor printing can be prevented when the print substrate such as a color filter and the electron source of the image displaying device are manufactured by printing.

2. Related Background Art

Recently, as image displaying devices for substituting for bulky and heavy Braun tubes, thin flat plate-shaped image displaying devices have been used. Among the flat plate-shaped image displaying devices, although liquid crystal displaying devices have been investigated and developed vigorously, the liquid crystal displaying device still has disadvantages in that an image becomes dark and that an angle of view is narrow. Further, as displays for substituting for the liquid crystal displaying devices, displays of self light emitting type, i.e., plasma displays, and displays using electron emitting elements such as fluorescent display tubes or surface conduction type electron emitting elements have been proposed. In the display of the self light emitting type, a brighter image can be obtained and the angle of view is wider, in comparison with the liquid crystal displaying device. On the other hand, recently, a Braun tube including a picture plane displaying portion having a dimension of 30 inches or more has been proposed, and larger Braun tubes have been requested. However, when the Braun tube is made large-sized, an installation space increases accordingly.

A flat plate-shaped display of self light emitting type is suitable for a large and bright display. The inventors paid attention to image displaying devices using electron emitting elements (among the flat plate-shaped image displaying devices of self light emitting type), particularly, an image displaying device using a surface conduction type electron emitting element proposed by M. I. Elinson et al. (Radio Engineering and Electronic Physics, No. 10, pp. 1290–1296, (1965)), in which emission of electrons could be achieved with a simple arrangement.

In the surface conduction type electron emitting element, electrons are emitted by flowing current through a thin film having a small area formed on a substrate in parallel with a surface of the film. As such surface conduction type electron emitting elements, a type using $SnO_2$ film proposed by M. I. Elinson et al., a type using Au film proposed by G. Dittmer (Thin Solid Films, No. 9, pp. 317–320 (1972)), a type using $In_2O_3/SnO_2$ film proposed by M. Hartwell & C. G. Fonstad (International Electron Devices Meeting Technical Digest, pp. 519–521 (1975)) and a type using carbon film proposed by Hisashi Araki et al. (Journal of the Vacuum Society of Japan, Vol. 26, page 22 (1983)) have been disclosed.

FIG. 10 is a schematic view showing an element structure proposed by M. Hartwell as a typical example of the surface conduction type electron emitting element. In FIG. 10, the reference numeral 1001 denotes a substrate. A conductive thin film 1004 consists of metal oxide film formed by spattering in an H-shaped pattern, and an electron emitting portion 1005 is formed by communication treatment called communication forming (described later). Incidentally, in FIG. 10, a distance L between element electrodes 1002, 1003 is selected, for example, to be 0.5 to 1 mm and a width W' is selected to be about 1 mm.

U. S. Pat. No. 5,066,883 discloses a surface conduction type electron emitting element in which fine particles for emitting electrons are dispersed and disposed between a pair of element electrodes. This electron emitting element can control an electron emitting position, in comparison with the abovementioned conventional surface conduction type electron emitting elements.

FIGS. 11A and 11B show typical element structures of this surface conduction type electron emitting element. FIG. 11A is a plan view of the element structure and FIG. 11B is a sectional view of the element structure. In FIGS. 11A and 11B, the reference numeral 1101 denotes an insulation substrate; 1102, 1103 denote element electrodes for achieving electrical connection; and 1104 denotes a conductive thin film. In this surface conduction type electron emitting element, a distance L between the pair of element electrodes is selected to be 0.01 to 100 $\mu$m, and a gap 1105 is formed in the conductive thin film 1104. Further, it is desirable that each element electrode has a thickness d of 200 nm or less in order to achieve electrical connection to the conductive thin film.

The inventors have investigated maximizing an area of an image displaying device in which a plurality of such surface conduction type electron emitting elements are disposed on the substrate. Various methods for manufacturing an electron source substrate in which the electron emitting elements and wirings are disposed on the substrate were considered, and, among them is a method for forming element electrodes and parallel wires by photolithography.

On the other hand, a method for forming an electron source substrate including such a surface conduction type electron emitting element by using a printing technique such as screen printing, offset printing or the like was also considered.

The printing method is suitable for forming a pattern having a large area. A number of surface conduction type electron emitting elements can be formed on the substrate by manufacturing the element electrodes of the surface conduction type electron emitting element by the printing method. Further, the manufacturing cost can be reduced. In the formation of the element electrode by using the printing method, the offset printing technique suitable for forming the thin film is advantageous. An example of the offset printing technique being applied to formation of a circuit substrate is disclosed in Japanese Pat. Application Laid-open No. 4-290295.

According to the substrate disclosed in the above Japanese patent document, in order to eliminate poor coupling due to dispersion in dimension of electrode pitches caused by expansion/contraction of the pattern during the printing, angles of a plurality of coupling electrodes to be connected to parts of the circuit are changed. Further, in the above Japanese patent application, a technique in which the electrode pattern is formed by the offset printing is described.

Generally, in the offset printing, after ink is loaded on an intaglio having a desired pattern, a rotating barrel called a blanket contacts the intaglio so that the blanket receives the ink. Thereafter, the rotating blanket contacts a glass substrate, thereby transferring the desired ink pattern onto a surface of the glass substrate.

In this way, in consideration of movement of the ink, one printing cycle is completed by three main stages, i.e., the loading step, receiving step and transferring step.

The printing ink can appropriately be selected on the basis of a function of the pattern to be formed. That is to say, regarding an electrode pattern for a recording thermal head and the like, ink mainly including organic Au metal called an Au resinated paste is used, and, regarding a color filter used in a liquid crystal displaying device, ink in which R (red), G (green) and B (blue) pigments are dispersed or ink including organic coloring matter is used. The solvent for such inks may be an organic solvent such as terpineol or butyl Carbitol.

When the organic solvent is used as the ink solvent in this way, as the ink pattern is transferred from the blanket to the glass substrate, the ink solvent penetrates into the blanket (mainly cylindrical rubber) to enhance a cohesive force of ink and to reduce interfacial tension between the ink pattern and the blanket, with the result that the ink is apt to be transferred to the glass substrate. This fact is described in Japanese Pat. Application Laid-open No. 7-156523.

In this case, when a medium to be printed has absorbing power such as paper, the ink solvent in the blanket also penetrates into the medium to be printed to some extent, thereby preventing excessive expansion of the blanket.

However, when the medium to be printed has no absorbing power such as glass, the ink solvent gradually accumulates in the blanket to increase the density of the ink solvent. If the amount of ink solvent exceeds a certain predetermined value, poor transferring will occur or the blanket will be expanded by the solvent, with the result that dimensional accuracy required for prints cannot be obtained, thereby causing poor printing.

In order to prevent inconvenience caused when the blanket absorbs excessive ink solvent, in some cases, the printing process is stopped temporarily, and hot gas is blown on the blanket to vaporize or dry the organic solvent absorbed in the blanket, and the printing process is restarted after cooling. However, if the continuous printing process is temporarily stopped and the blanket treatment operation is performed, productivity will be worsened.

On the other hand, if the density of ink solvent in the blanket is too low, the solvent in the received ink pattern is excessively absorbed in the blanket rubber and is solidified on the blanket surface, with the result that, even when the blanket is closely contacted with the glass substrate to transfer the ink pattern to the glass plate, the ink pattern may still remain on the blanket surface, thereby causing poor printing. In such a case, as described in Japanese Patent Application Laid-open No. 8-48070, it is required that ink solvent be previously penetrated into the silicone rubber of the blanket in any manner before initiation of the printing.

If the poor print generated by improper amount of ink solvent in the blanket is obtained when using a cheap and disposable medium such as paper, the poor print may be discarded as it is.

However, when the print is obtained when using an electrode, wiring and/or color filter of an image displaying device, since various structures were already formed before the offset printing or since the cost of the medium to be printed itself, such as special glass, is high, the poor print cannot be discarded freely. Further, if regeneration or reuse is achieved in any way, cost will be increased.

In the past, since countermeasures were considered in the stage where the poor printing was generated due to excessive expansion or excessive drying of the blanket, poor prints were eventually generated. Further, since all portions (several hundred-thousand points) of an ultra-fine pattern had to be checked to find the poor print, throughput was worsened and the total cost was increased.

SUMMARY OF THE INVENTION

An object of the present invention is to provide a printing apparatus capable of minimizing occurrence of poor print.

Another object of the present invention is to provide a method for manufacturing a print substrate, in which parts of a desired pattern can be formed on a substrate in a reproducible manner A further object of the present invention is to provide a method for manufacturing an electron source, in which a plurality of electron emitting elements can be formed on a substrate in a reproducible manner.

A still further object of the present invention is to provide a method for manufacturing an image displaying device, in which an image displaying device capable of displaying an image with high quality can be manufactured in a reproducible manner.

Still another object of the present invention is to provide a method for manufacturing a print substrate, an electron source or an image displaying device, in which throughput can be improved considerably.

The present invention provides an offset printing apparatus for transferring an ink pattern onto a medium to be printed through a blanket, comprising a detecting means for detecting an amount of ink solvent penetrated into the blanket.

The detecting means may be a means for detecting light reflected from the blanket or a means for measuring a thickness of the blanket.

The present invention may further comprise a control means for controlling the amount of ink solvent penetrated into the blanket.

The control means may be a means for maintaining the amount of ink solvent penetrated into the blanket within a desired range.

Further, the present invention provides a method for manufacturing a print substrate, wherein parts of a desired pattern are formed on a substrate by using the above-mentioned printing apparatus.

In this method, conductive members may be formed as the desired pattern.

The present invention further provides a method for manufacturing an electron source including a plurality of electron emitting elements and wirings for interconnecting the plurality of electron emitting elements on a substrate, wherein the plurality of electron emitting elements are manufactured by using the above-mentioned printing apparatus.

In the electron source manufacturing method, the electron emitting element may comprise a pair of electrodes, and a conductive thin film having an electron emitting portion disposed between the pair of electrodes, and the pair of electrodes may be manufactured by using the above-mentioned printing apparatus.

In the electron source manufacturing method, wiring for the electron source may be formed by using a screen printing method.

Further, the present invention provides a method for manufacturing an image displaying device comprising an electron source including a plurality of electron emitting elements and wirings for interconnecting the plurality of electron emitting elements, and a fluorescent body lighted by electrons emitted from the electron source on a substrate, wherein the electron source is manufactured by the above-mentioned method.

DESCRIPTION OF THE PREFERRED EMBODIMENTS

The present invention will now be explained in connection with embodiments thereof with reference to the accompanying drawings.

First of all, in the present invention, "print substrate" means a substrate on which electric/electronic devices are patterned and may include a color filter substrate for a liquid crystal display, a substrate on which electrodes for driving a plasma display, an electron source display or other display are patterned, or a substrate on which structural parts of the electron source are patterned.

Now, an embodiment of the present invention will be explained with reference to the accompanying drawings.

Figure 1:
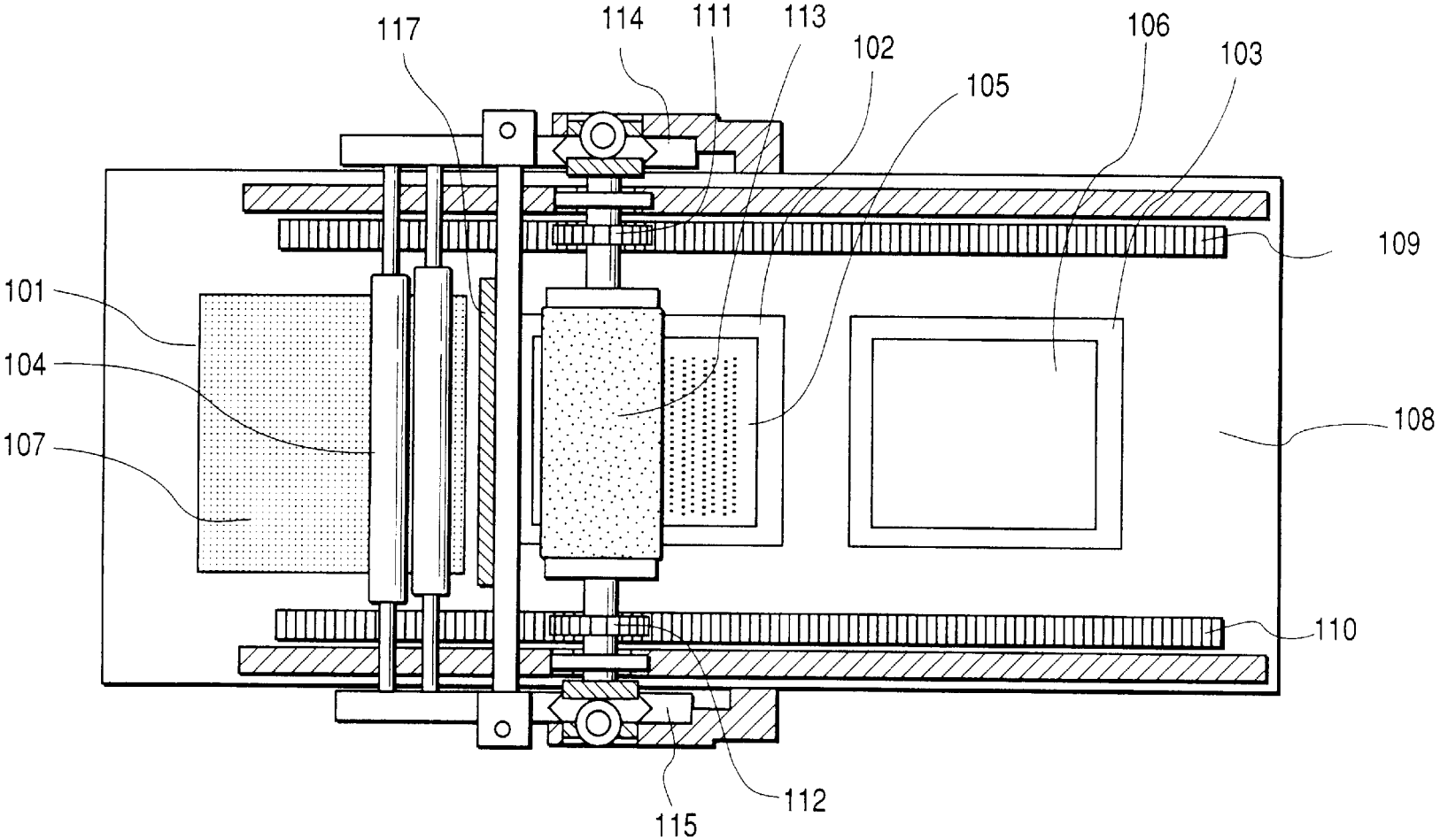
FIG. 1 is a partial top view of a printing apparatus according to the present invention.

FIG. 1 is a schematic partial top view of a printing apparatus according to a first embodiment of the present invention.

In FIG. 1, an ink roller 104 serves to spread ink 107 on an ink distributing plate 101, and a block support plate fixing table 102 serves to secure or fix an intaglio 105. A work fixing table 103 serves to secure or fix a work 106 as a medium to be printed and is fixedly disposed on a body frame 108. Two rack gears 109, 110 are arranged on both sides of the three fixing tables disposed in a line, and a blanket 113 is disposed above the rack gears 109, 110, with gears 111, 112 meshed with the rack gears. A shaft of the blanket 113 is secured to two side carriages 114, 115 so that the blanket 113 is successively rolling on the intaglio 105 and work 106 by advancing the carriages 114, 115 by means of a crank arm (not shown) disposed at a lower part of the body. The surface of the blanket 113 is covered by blanket rubber.

In this printing apparatus, transferring an ink pattern to the work (medium to be printed) 106 through the blanket 113 is effected as follows.

Figure 2A:
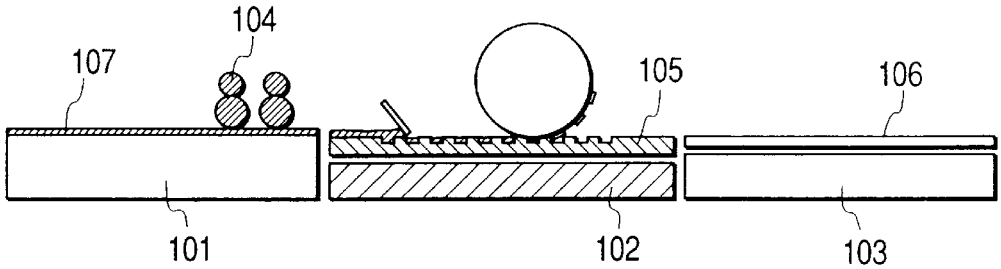
FIGS. 2A, 2B, 2C and 2D are side views showing printing processes of the printing apparatus of FIG. 1.
Figure 2B:
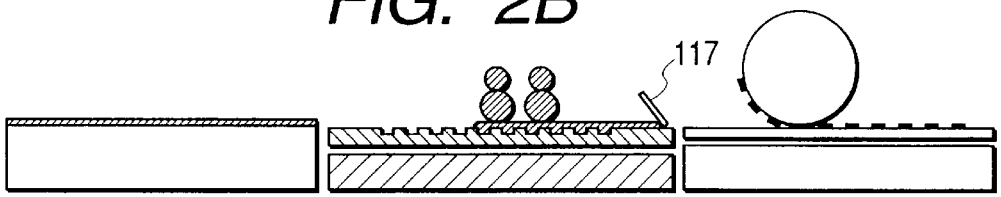
Figure 2C:
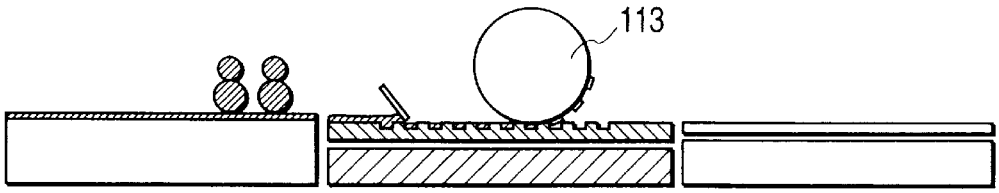
Figure 2D:
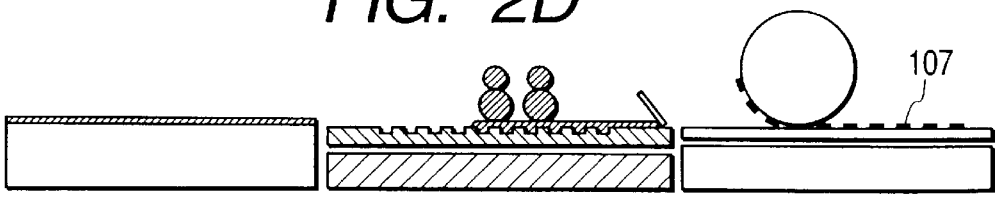

In FIGS. 2A to 2D, the ink distributing plate 101, intaglio 105 and work or glass substrate (medium to be printed) 106 are arranged in series and are flush with each other. The ink roller 104 serves to feed the ink 107 distributed on the ink distributing plate 101 to the intaglio 105 (FIG. 2A). A doctor blade 117 slides on the intaglio 105 to load the fed ink 107 onto the intaglio 105 and to scrape excessive ink (FIG. 2B). The blanket 113 successively rolls on the intaglio 105 and the glass substrate 106 to receive the ink loaded in recesses of the intaglio 105 (FIG. 2C) and to transfer the ink 107 onto the glass substrate 106 in accordance with the pattern of the intaglio 105 (FIG. 2D).

In this way, in consideration of movement of the ink, one printing cycle is completed by three main stages, i.e., a loading step, receiving step and transferring step.

The printing ink 107 can appropriately be selected on the basis of a function of the pattern to be formed.

That is to say, regarding a conductive member pattern such as an electrode pattern, ink mainly including organic Au metal called Au resinated paste is used, and, regarding a color filter used in a liquid crystal displaying device, ink in which R (red), G (green) and B (blue) pigments are dispersed or ink including organic coloring matter is used. The solvent for such inks may be an organic solvent such as terpineol or butyl Carbitol.

Figure 3:
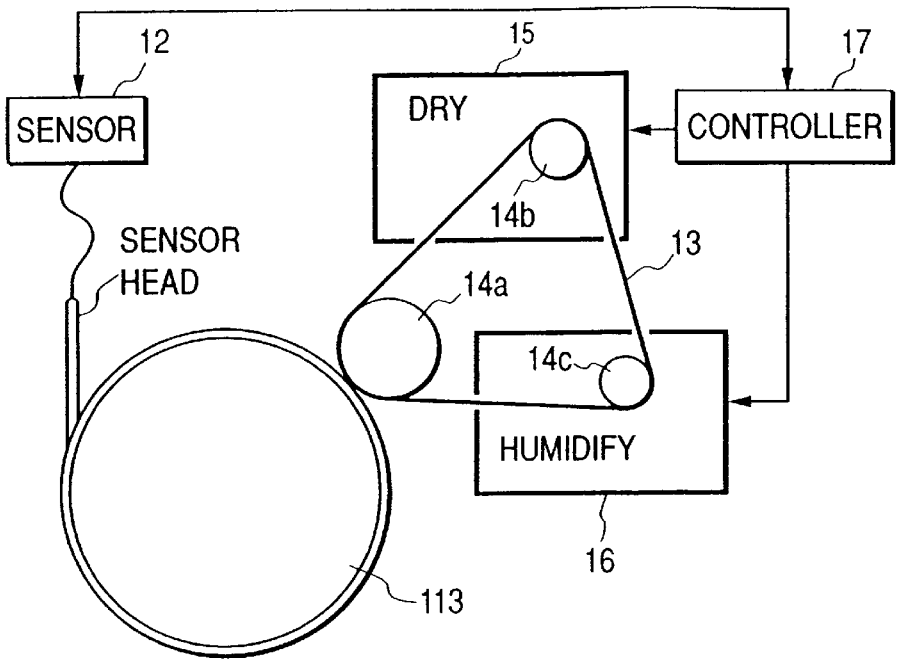
FIG. 3 is a partial conceptional view of the printing apparatus according to the present invention.

The printing apparatus according to the illustrated embodiment shown in FIG. 1 further has a mechanism shown in FIG. 3.

FIG. 3 is a conceptional view showing a part of the printing apparatus according to the illustrated embodiment. The printing apparatus according to-the illustrated embodiment shown in FIG. 3 detects an amount of ink solvent in the blanket 113 and controls the amount of ink solvent. As shown in FIG. 3, the printing apparatus according to the illustrated embodiment includes the blanket 113, a sensor 12 for detecting a condition of the blanket 113, and a humidity adjusting portion for adjusting humidity of the blanket 113. That is to say, on the basis of an output of the sensor, the humidity of the blanket 113 is adjusted.

The humidity adjusting portion is designed so that a belt-shaped moisture absorbing sheet 13 under tension is urged against the blanket 113. The moisture absorbing sheet 13 is rotated by rollers 14*a*, 14*b*, 14*c*. In order to adjust the solvent containing amount of the blanket 113, in response to feedback regarding a wetted condition of the ink solvent of the blanket 113, a controller 17 controls a humidifying mechanism 16 for humidifying the solvent ink and a drying mechanism 15 for drying the solvent ink.

The moisture absorbing sheet 13 may be a non-woven fabric or a paper that does not generate dust, such as Zaviena (manufactured by Kanebo Goi K.K.) or Technicross 2 (manufactured by TEXWIPE Corp.).

The humidity adjusting portion shown in FIG. 3 is merely an example, and the present invention is not limited to such an example. For example, a humidifying method in which the ink solvent is previously penetrated into the moisture absorbing sheet may be used. Further, the moisture absorbing sheet 13 may appropriately be replaced by a new one in accordance with the amount of ink solvent expanding the blanket.

That is to say, according to the printing apparatus of the illustrated embodiment, in an offset printing apparatus for transferring the ink pattern formed on the intaglio or flat block onto the medium to be printed through the blanket, there is provided a mechanism for detecting (in a non-destructive manner) a parameter having an influence upon the transferring ability from the blanket to the medium to be printed, such as the amount of ink solvent impregnated into the blanket or the expanding condition of the blanket.

Further, there is provided a blanket humidity adjusting mechanism in which the parameter representative of the transferring ability from the blanket to the medium to be printed is fed back so that the humidity is controlled to be included within a predetermined range.

The mechanism for monitoring (in the non-destructive manner) the parameter having an influence upon the transferring ability from the blanket to the medium to be printed does not necessarily measure the absolute amount of the ink solvent included in the blanket but may relatively detect the solvent gradually impregnated into the blanket as the number of printing papers is increased.

To this end, for example, a micro Raman method can be used. Further, a method in which solvent is vertically dropped onto the blanket surface and a contact angle is measured can also be used. Further, such detection can be made by closely contacting an ATR (attenuated total reflection) attachment mounted on an infrared absorption analyzing device with the blanket.

In particular, the infrared absorption analysis is a very common chemical analyzing means, and various attachments can be designed in dependence upon specimen aspects. More specifically, the ATR (attenuated total reflection) absorption measuring method may be utilized. The principle and measurement of the ATR method are described in detail in the magazine "Base and Practice of FT-IR" (pages 67 to 72) by Mitsuo Tazumi, published by Tokyo Kagaku Dojin Sha. Further, in order to actually apply the ATR method to the present invention, for example, an ATR needle probe may be mounted on an FT-IR measuring device (FTS-135) manufactured by BIO-RAD Co. In this case, the spectral crystal is ZeSe.

Figure 4:
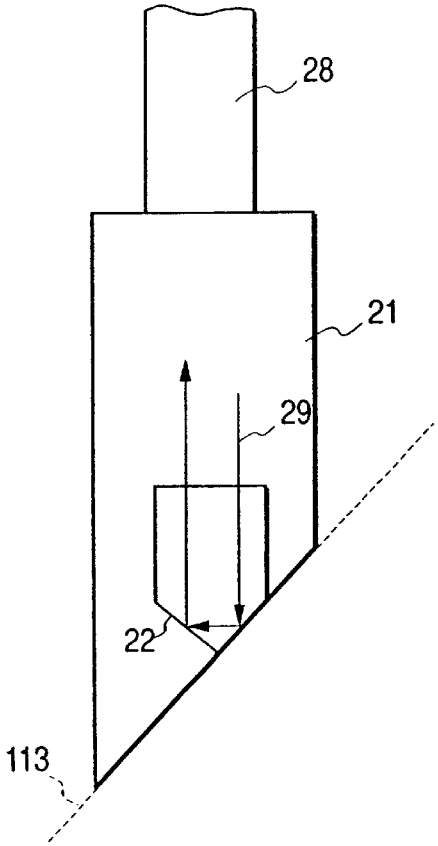
FIG. 4 is a sectional view of an FT-IR ATR probe.

FIG. 4 is a sectional view of a sensor head used in the ATR method. As shown in FIG. 4, the sensor head is an ATR probe 21 having spectral crystal 22. A tip end of the ATR probe 21 is cut obliquely, and an outer surface is covered by stainless steel. A laser beam 29 including an infrared area emitted from a laser oscillator is incident on the ATR crystal through a glass fiber 28, and, after the beam penetrates into the blanket surface by a depth d, the beam is total-reflected. By measuring wavelength dependency of energy of the reflected beam, an attenuated total reflection (ATR) spectrum can be obtained. Such data is taken in, Fourier-transformed and data-treated. The treated data is inputted to the controller 17 shown in FIG. 3.

Identification of the ink solvent in the ATR spectrum can be effected, for example, by utilizing a peak of position of about 1730 $cm^{-1}$ in absorption of a ketone portion of dibutyl phthalate in the solvent. Further, as an internal reference peak for quantative determination, a peak position of about 1260 $cm^{-1}$ in absorption of dimethyl silicone of the blanket 113 can be utilized.

In the blanket humidity adjusting portion of the printing apparatus according to the illustrated embodiment, as shown in FIG. 3, the belt-shaped moisture absorbing sheet 13 under tension is urged against the blanket 113. Further, in order to adjust the amount of solvent impregnated into the blanket, there is provided a mechanism in which, in response to feedback regarding the wetted condition of the ink solvent of the blanket, the controller controls the humidifying mechanism for humidifying the solvent ink and the drying mechanism for drying the solvent ink.

By transferring the ink solvent from the blanket to a sheet having moisture absorbing ability (in place of the glass substrate), the amount of ink solvent of the blanket can easily be reduced. Further, the moisture absorbing sheet may be a non-woven fabric or a paper that does not generate dust, such as Zaviena (manufactured by Kanebo Goi K.K.) or Technicross 2 (manufactured by TEXWIPE Corp.). Further, a humidifying method in which the ink solvent is previously penetrated into the moisture absorbing sheet may be used, and the moisture absorbing sheet may appropriately be replaced by a new one in accordance with the amount of ink solvent expanding the blanket.

Figure 5:
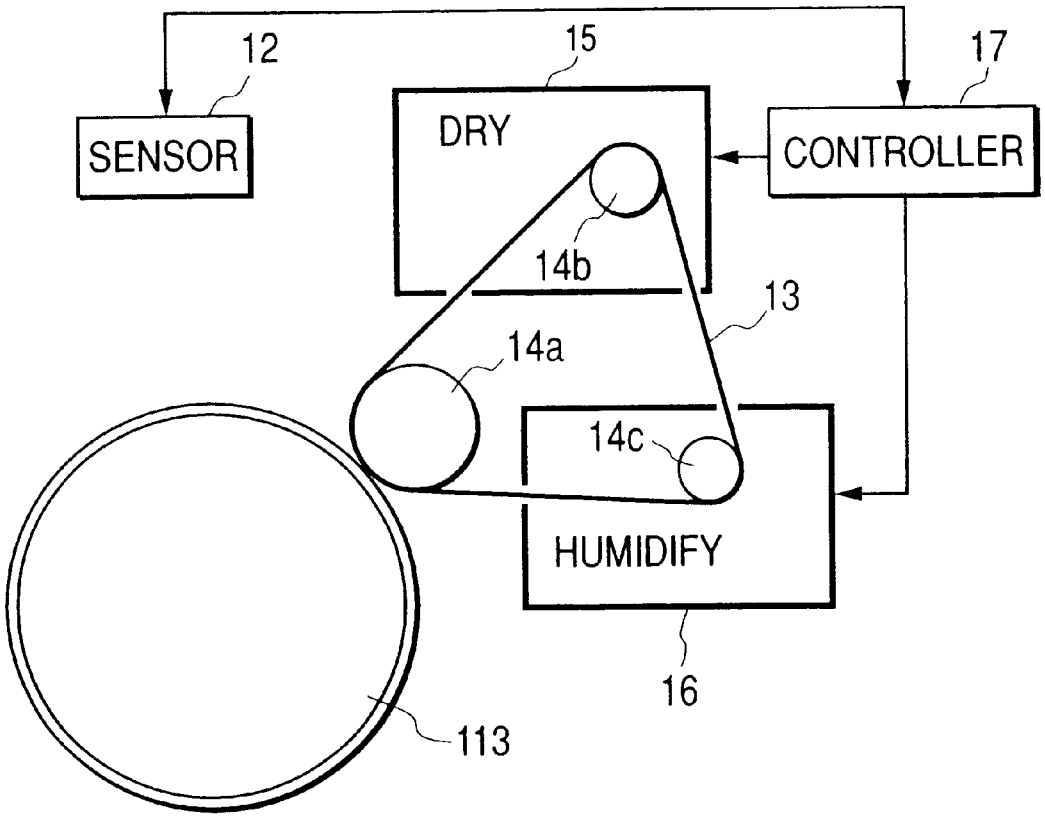
FIG. 5 is a partial conceptional view of another printing apparatus according to the present invention.

FIG. 5 is a partial conceptional view showing a printing apparatus according to another embodiment of the present invention.

This printing apparatus differs from the printing apparatus shown in FIG. 3 regarding a sensor 12 for detecting a condition of the blanket 113. The sensor 12 of the printing apparatus shown in FIG. 5 can effectively detect the condition of the blanket 113 in a non-contact manner. For example, the sensor 12 comprises a laser displacement measurement device, and a height of the surface of the blanket 113 is effectively monitored by using the laser displacement measurement device.

In the printing apparatus shown in FIG. 5, data from the laser displacement measurement device is compared with predetermined data regarding the amount of solvent absorbed by the blanket, change in height of the blanket and printing ability thereof, and, on the basis of a comparison result, the solvent containing amount of the blanket is controlled. The control of the solvent containing amount of the blanket is effected by controlling the humidifying mechanism 16 and the drying mechanism 15 by the controller 12, as is in the printing apparatus shown in FIG. 3.

The change in height of the blanket depends upon a change in volume of the blanket due to absorption of the ink solvent. Thus, there is a steady relative relationship between the ink solvent absorbing amount of the blanket and the change in height of the blanket. Accordingly, by monitoring the change in height of the blanket, the amount of ink solvent impregnated into the blanket can be detected, and, on the basis of the detection result, by controlling the blanket humidity adjusting portion including the humidifying mechanism and the drying mechanism, the amount of ink solvent impregnated into the blanket can be adjusted, thereby preventing occurrence of poor prints due to poor ink transferring.

Further, the measurement of the height of the surface of the blanket may be effected by using a contact probe method. However, when the laser displacement measurement device is used, since the change in height of the blanket can be detected in a non-contact manner, the measurement can be performed regardless of contamination and/or deformation of the surface of the blanket. This is preferable in the illustrated embodiment.

Further, the ink solvent amount detecting method and the blanket humidity adjusting method are not limited to the above-mentioned ones.

Embodiments

Now, the present invention will be fully described in connection with concrete embodiments.

In the embodiments described hereinbelow, the printing apparatus shown in FIG. 1 was used. Here, the intaglio 105 was formed from blue plate glass, and each recessed pattern was a rectangular pad pattern having a width of 150 $\mu$m, a length of 300 $\mu$m and a depth of 8.0 $\mu$m, and 720 patterns were arranged side by side in a horizontal direction and 240 patterns were arranged side by side in a vertical direction. Paste including organic platinum (N.E. KemCat K.K.) was used as the ink. Terpineol and DBP (dibutyl phthalate) were used as the ink diluting solvent.

Further, a commercially available blanket having a surface layer of dimethyl silicone rubber was used as the blanket.

Embodiment 1

The sensor 12 for detecting the condition of the blanket shown in FIG. 3 was set in the printing apparatus shown in FIG. 1, and 50 sheets of paper were printed continuously at a tact time of about 70 seconds on the blue plate glass by using the above-mentioned ink, intaglio and blanket. In this case, after every two sheets of paper, the surface of the ATR probe of FT-IR shown in FIG. 4 was vertically urged against the blanket, and a condition of the ink solvent impregnating into the blanket was monitored.

After the general printing was finished, when the patterns of the printed matter were observed in detail, it was found that, in the twentieth and subsequent sheets of paper, the film thickness of ink at a central portion and therearound of the entire pattern was gradually decreased to distort the straight portions. This tendency was most noticeable in the fiftieth sheet of paper, and it seemed that the printed condition worsened as the ink solvent was impregnated into the blanket.

Figure 6:
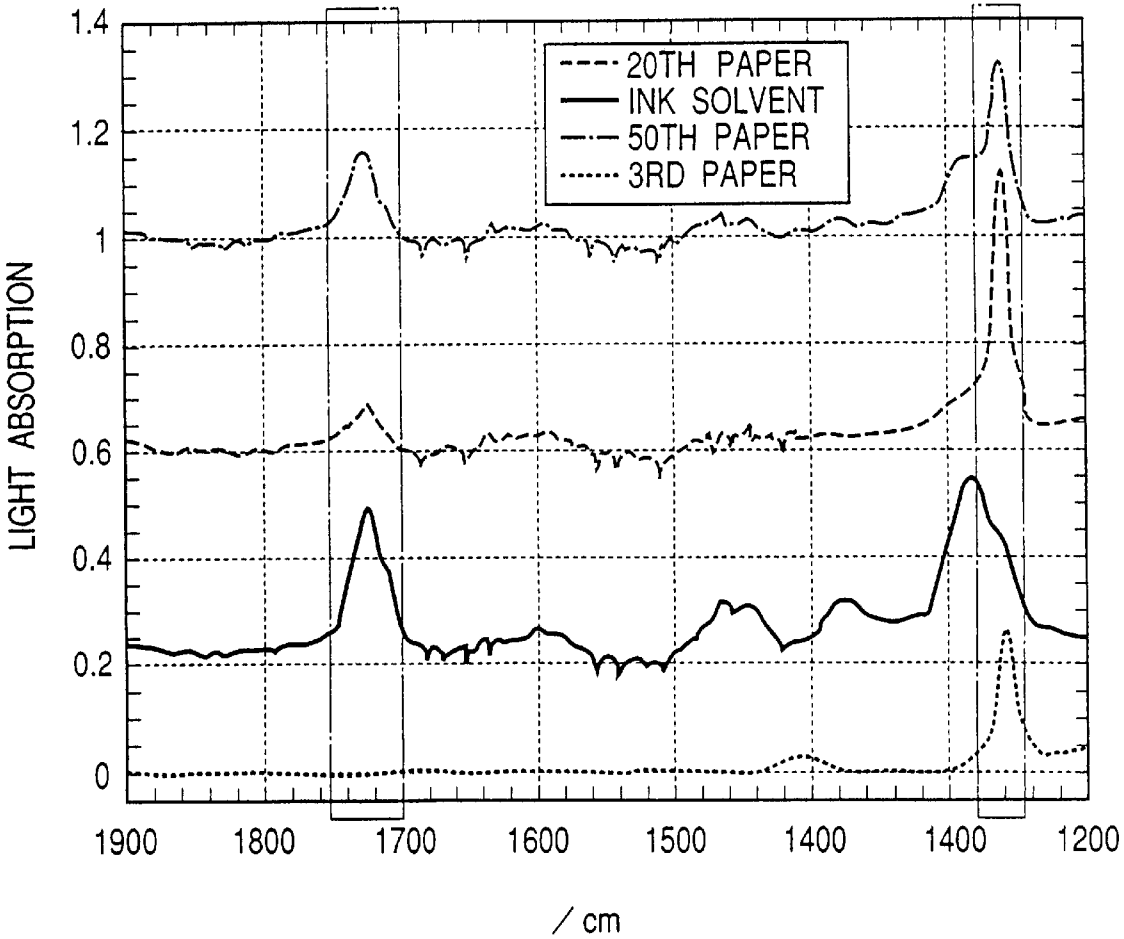
FIG. 6 is a chart showing an example of an ATR spectrum.

FIG. 6 shows a profile of FT-IR actually monitored in this case. It can be seen that the peak in the vicinity of 1730 $cm^{-1}$ which was almost not detected in the third sheet of paper became noticeable in the twentieth sheet of paper and became remarkable in the fiftieth sheet of paper. When a ratio between the peak area of this portion and the peak area of dimethyl silicone in the vicinity of 1260 $cm^{-1}$ (internal reference) was calculated, it could be judged that the poor printing occurs depending on how much ink solvent impregnates into the blanket, and, thus, occurrence of the actual poor printing can be predicted, and any countermeasure can be adopted.

Embodiment 2

The blanket humidity adjusting portion shown in FIG. 3 was set in the printing apparatus shown in FIG. 1, and 100 sheets of paper were printed continuously in the similar manner as in Embodiment 1. The ink humidity degree calculated from the data of FT-IR was inputted to the blanket humidity adjusting portion so that the solvent ink humidifying mechanism and the drying mechanism were controlled by the controller to maintain the value of the ink humidity degree within a proper range.

After the printing was finished, and after all of the prints were checked, it was found that there was almost no unevenness in ink thickness and prints having good straightness of pattern could be obtained.

Incidentally, in this case, although the ink solvent humidifying mechanism was not operated, since the blanket may be dried excessively in dependence upon the kind of ink solvent, tact time, aperture ratio of the pattern and/or material of the blanket, the ink solvent humidifying mechanism must be provided.

Embodiment 3

Now, a method for manufacturing an image displaying apparatus in which element electrodes of electron emitting elements are formed by the offset printing will be described.

Figure 11A:
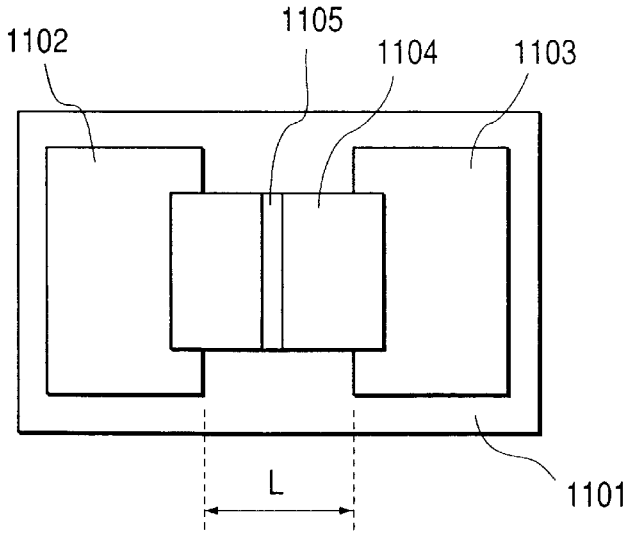
FIGS. 11A and 11B are views showing a surface conduction type electron emitting element.
Figure 11B:
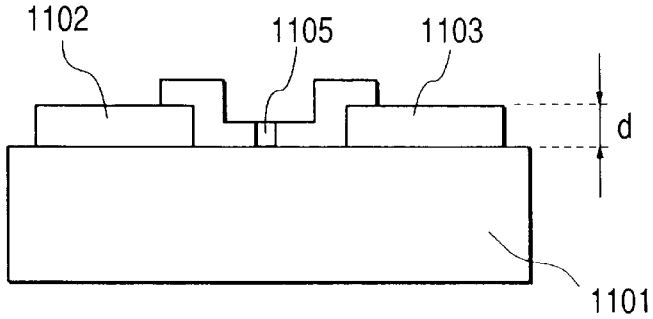

The pair of element electrodes (1102, 1103 in FIGS. 11A and 11B) constituting the electron emitting element were formed and printed on the glass substrate by the printing apparatus described in connection with the above-mentioned embodiment. In this example, Pt resinated paste (manufactured by N.E. KemCat K.K.) comprised of organic metal was used as the ink. After the ink transferred to the glass substrate was dried at a temperature of about 80° C. for 10 minutes, firing was effected at a temperature of 550° C. The product can be used as an element electrode mainly including platinum. A thickness of the ink on the glass substrate after transferring and drying was about 3 $\mu$m. Further, the thickness of each Pt electrode after firing could be as thin as about 500 Å. As shown in FIGS. 11A and 11B, the element electrodes have an electrode-to-electrode distance L, and in this embodiment the distance L was set to about 20 $\mu$m.

With respect to the element electrodes formed in this way, by forming a conductive film comprised of wirings and Pd fine particles, an electron source substrate can be manufactured. Now, an explanation will be made with reference to the accompanying drawings.

Figure 8:
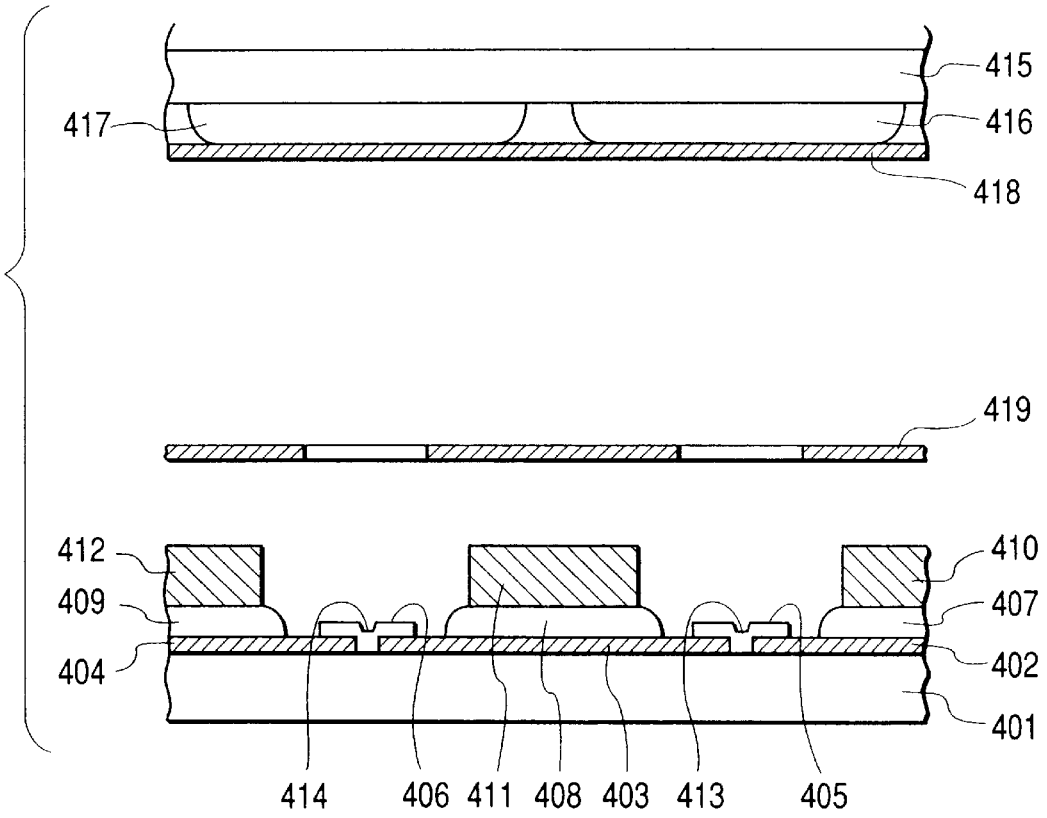
FIG. 8 is a sectional view of an image displaying device according to a third embodiment of the present invention.

In FIG. 8, the reference numeral 401 denotes an electron source substrate formed from blue plate glass; and 402, 403, 404 denote element electrodes formed by offset printing in accordance with the present invention (formed in a direction perpendicular to the plane of FIG. 8). The reference numerals 407, 408, 409 denote print wirings having a thickness of about 7 microns and formed from Ag paste ink by screen printing and firing (formed in a direction perpendicular to the plane of FIG. 8). The element electrodes 402, 403, 404 are connected to the print wirings 407, 408, 409, respectively. The reference numerals 405, 406 denote conductive films (corresponding to 1104 in FIGS. 11A and 11B) including fine Pb particles and having a thickness of about 200 Å and obtained from an organic metallic solution by coating and firing, and these conductive films were patterned from Cr thin film by reverse etching so that they are disposed on and between the element electrodes 402, 403, 404. Electroplated wirings 410, 411, 412 were formed from copper by electroplating on the print wirings 407, 408, 409 with a thickness of about 50 microns and a width of 400 microns. A glass substrate 415 comprised of blue plate glass is opposed to the electron source substrate 401 at a distance of 5 mm. Fluorescent bodies 416, 417 are disposed on the substrate 415 and are located at positions corresponding to areas between the element electrodes 402, 403, 404 disposed on the opposed electron source substrate 401. The fluorescent bodies 416, 417 are obtained by coating and drying a slurry comprised of a mixture of photosensitive resin and fluorescent substance and then by patterning them by means of photolithography. A metal back 418 is obtained in such a manner that, after a filming process is effected on the fluorescent bodies 416, 417, a thin aluminium film having a thickness of about 30 nm is formed by vacuum deposition and the firing is effected to remove the film layer. The assembly obtained by forming such fluorescent bodies and metal back on the glass substrate is called a "face plate".

A grid electrode 419 is disposed between the element substrate and the face plate. After the abovementioned members are located within a vacuum enclosure, voltage is applied between the electroplated wirings 410, 411, 412 to effect communication treatment of the conductive films 405, 406, thereby forming gaps 413, 414 (corresponding to 1105 in FIGS. 11A and 11B) in the conductive films 405, 406. Thereafter, when an electron deriving voltage of 5 kV was applied to the metal back as the anode electrode and a voltage of 14 V was applied from the element electrodes 402, 403 to the conductive film 405 through the electroplated wirings 410, 411, 412, electrons were emitted. The emitted electrons were modulated by changing the voltage applied to the grid electrode 419, with the result that the amount of emitted electrons illuminated on the fluorescent body 416 could be adjusted. In this way, the fluorescent body 416 could be lighted as desired.

Similarly, when a voltage of 14 V was applied from the element electrodes 403, 404 to the conductive film 406, electrons were emitted. The emitted electrons were modulated by changing the voltage applied to the grid electrode 419, with the result that the amount of emitted electrons illuminated on the fluorescent body 417 could be adjusted. In this way, the fluorescent body 417 could be lighted as desired.

Incidentally, in the drawings, while an arrangement regarding two display pixels was explained, the number of display pixels is not limited to two. Accordingly, the wirings and grids may be formed in a matrix pattern so that, by driving a plurality of electron emitting elements, any image can be displayed by a plurality of display pixels.

It was found that there is no cross-talk of fluorescent bright point due to positional deviation between the plurality of electron emitting elements and the fluorescent bodies. Further, it was found that there is very little dispersion in luminance in the entire display area. It is considered that this means that there is little dispersion in configuration and property of the element electrodes manufactured by the offset printing in accordance with the present invention.

Embodiment 4

Now, the printing apparatus and printing method according to the present invention, and another image displaying device using such printing apparatus and method will be explained as a further embodiment.

Hereinbelow, FIGS. 9A to 9E are described.

Figure 9A:
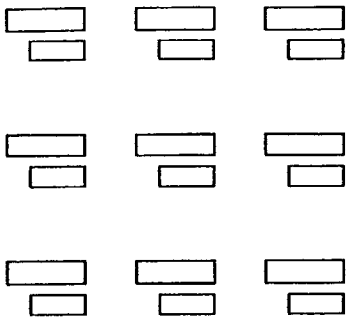
FIGS. 9A, 9B, 9C, 9D and 9E are top views of an image displaying device according to a fourth embodiment of the present invention.
Figure 9B:
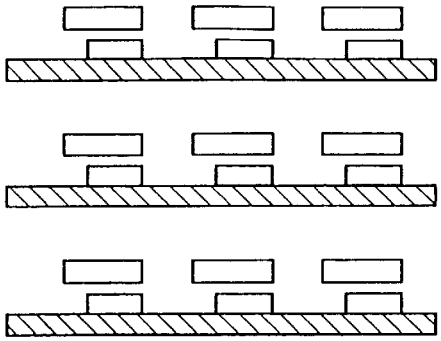
Figure 9C:
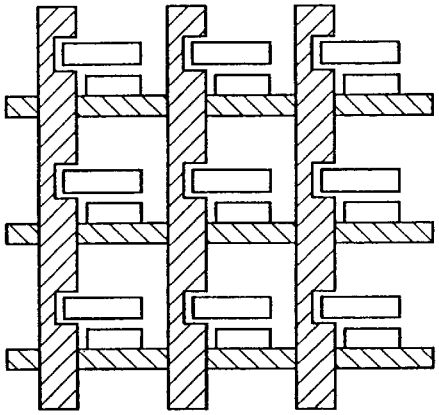
Figure 9D:
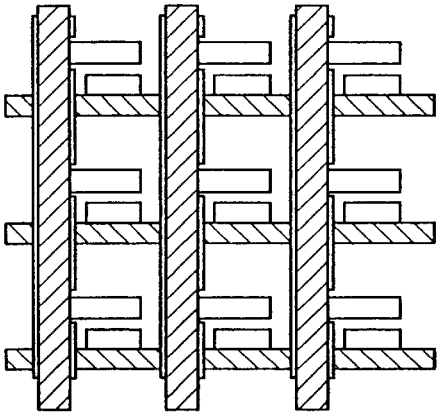
Figure 9E:
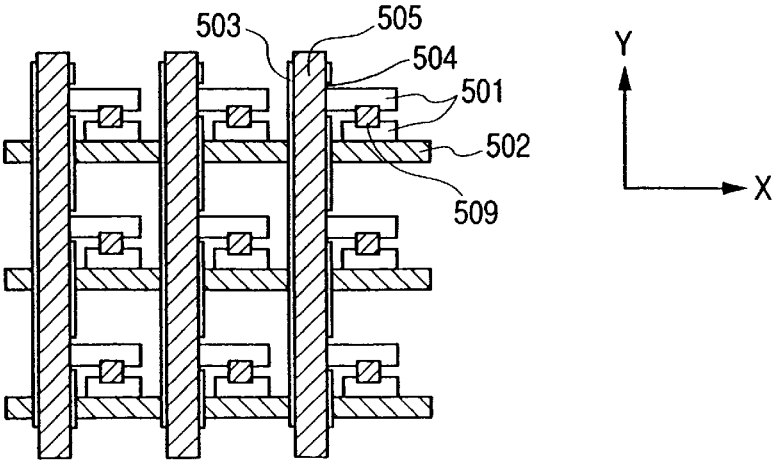
Figure 10:
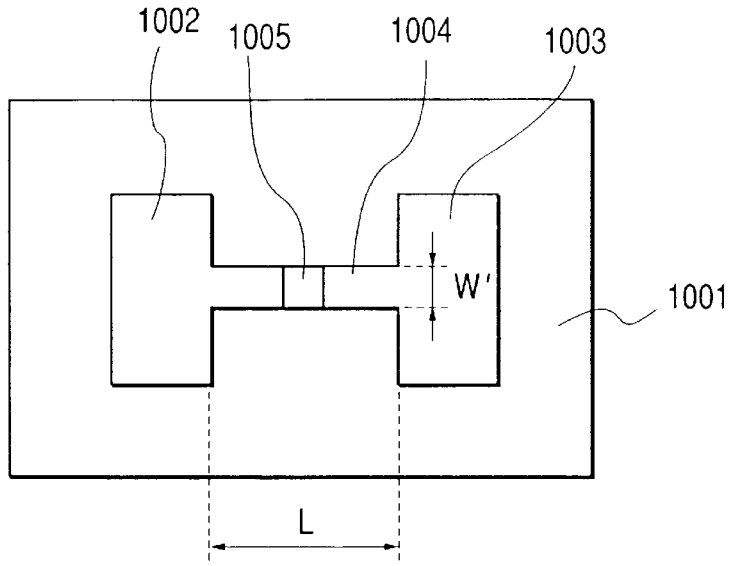
FIG. 10 is a top view showing a surface conduction type electron emitting element.

FIGS. 9A to 9E are top views showing steps for manufacturing a surface conduction type electron emitting element substrate of an image displaying device formed by using the manufacturing apparatus of the present invention. FIG. 9E shows an example that nine electron emitting elements are arranged in a matrix pattern (3×3) with wirings. In FIG. 9E, element electrodes 501 are formed by offset printing. According to the illustrated embodiment, in the element electrode pattern, a rectangular electrode having a dimension of 500 μm×150 μm and a rectangular electrode having a dimension of 350 μm×200 μm are spaced apart with a gap of 20 μm and constitute a pair, and a plurality of pairs are arranged in a matrix pattern. Lower layer print wirings 502 are formed from print Ag paste by firing, and strip-shaped insulation layers 503 formed from print glass paste by firing are disposed perpendicular to the lower layer print wirings. The insulation layer 503 has notched openings 504 each located at a position corresponding to one of each pair of element electrodes 501. Strip-shaped upper layer print wirings 505 formed from print Ag paste by firing are disposed on the insulation layers 503 and each is electrically connected to one of each pair of element electrodes 501 through the corresponding opening 504. The lower layer wirings 502, insulation layers 503 and upper layer wirings 505 are formed by screen printing. Thin films 509 comprised of fine Pb particles are disposed on and between the element electrodes 501.

Now, a method for manufacturing the element substrate will be described with reference to FIGS. 9A to 9E.

A square electron source substrate having a dimension of 40 cm×40 cm, on which a plurality of pairs of element electrodes formed by the offset printing explained in connection with Embodiments 1 and 2 are disposed, is prepared (FIG. 9A).

The first wirings (lower layer wirings) are firstly formed on the substrate. Silver paste is used as the conductive paste, and printing and firing are effected by screen printing. In this way, the lower layer wiring having a width of 100 μm and a thickness of 12 μm is formed (FIG. 9B).

Then, layer-to-layer insulation films are formed by screen printing along a direction perpendicular to the lower layer wirings. The paste material is glass paste mainly including zinc oxide with glass binder and resin mixed. Printing and firing of the glass paste are repeated by two times by screen printing to form stripe-shaped layer-to-layer insulation (FIG. 9C).

Then, the second wirings (upper layer wirings) are formed on the layer-to-layer insulation films. In the same manner as the lower wirings, the upper layer wirings having a width of 100 μm and a thickness of 12 μm are formed by screen printing. In this way, matrix wiring, in which the stripe-shaped lower layer wirings and the upper layer wirings are perpendicular to each other with the interposition of the layer-to-layer insulation films, are formed (FIG. 9D).

Then, the conductive films are formed. First of all, organic palladium is coated, by an ink jet method, on the substrate on which the wirings were formed. Thereafter, heating treatment at a temperature of 300° C. is effected for 10 minutes to form conductive films comprised of PdO and having a thickness of 10 nm. Here, the fine particle film includes a combination of a plurality of fine particles and means not only a film in which respective fine particles are dispersed, but also a film in which fine particles are adjoined or overlapped (including an island shape), and the particle diameter means a diameter of the fine particles recognizable in such conditions. In this way, the electron source substrate before assembly is completed (FIG. 9E).

The electron source substrates are arranged on the square substrate having a dimension of 40 cm×40 cm in such a manner that 980 electron emitting elements are disposed in a matrix pattern (480×480) and are installed within a vacuum enclosure together with the face plate having fluorescent bodies corresponding to R (red), G (green) and B (blue). Thereafter, the electron emitting elements are subjected to communication treatment, and gaps are formed in the conductive films, thereby forming the electron passing portions in the conductive films. A voltage of 14 Volts was applied to the upper layer wirings of the element substrate, a potential of 0 Volts was maintained in the lower layer wirings and a potential of 7 Volts was maintained in the remaining portions. When an anode voltage of 5 kV was applied to the metal back of the face plate, it was found that any image could be displayed. Further, similar to Embodiment 3, it was found that there is little dispersion in luminance in the entire element area.

Embodiment 5

Figure 7:
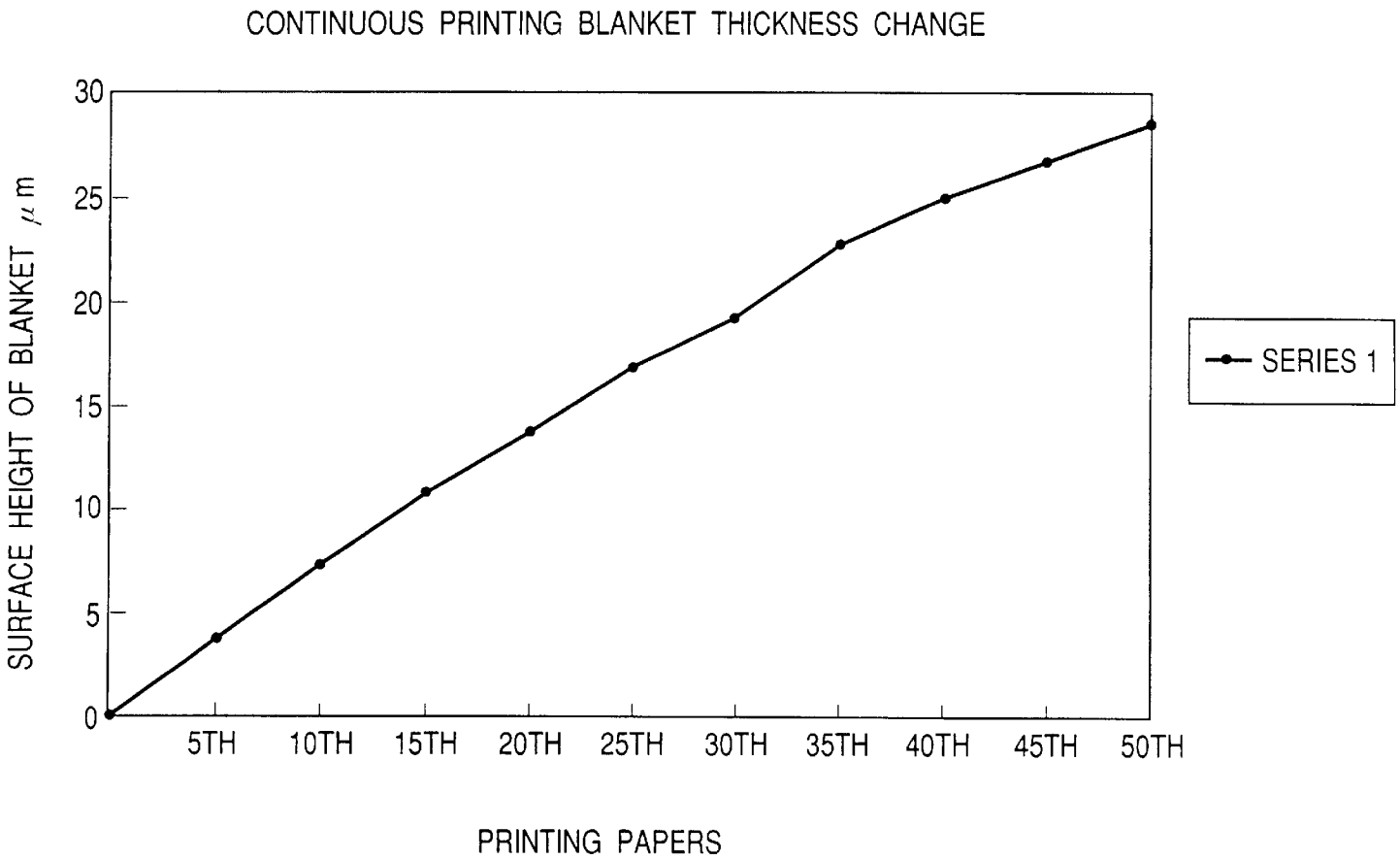
FIG. 7 is a graph showing an example of a relationship between printing papers and the degree of expansion of a blanket.

The sensor (laser displacement measuring device) 12 for detecting the condition of the blanket shown in FIG. 5 was set in the printing apparatus shown in FIG. 1, and 50 sheets of paper were printed continuously at a tact time of about 180 seconds on the blue plate glass by using the above-mentioned ink, intaglio and blanket. In this case, after every five sheets of paper, the height of the surface of the blanket corresponding to a substantially central portion of the print pattern was measured by the laser displacement measuring device. As the reference for the height of the surface of the blanket, immediately before initiation of first paper printing, the reference value was set to zero, and an increase in height is indicated by "+". The obtained data is shown in FIG. 7.

After the general printing was finished, when the patterns of the printed matter were observed in detail, it was found that at about the twenty-second sheet of paper, poor ink transferring started to occur and the rate of poor transferring gradually increased with the subsequent sheets of paper.

As a result, in the printing condition according to this embodiment, it was found that a threshold value in which the poor printing occurs due to expansion of the blanket is about 15 microns (measured surface height of the blanket).

Embodiment 6

The blanket humidity adjusting portion shown in FIG. 5 was set in the printing apparatus shown in FIG. 1, and 100 sheets of paper were printed continuously in a similar manner as that in Embodiment 5. The ink humidity degree calculated from the data regarding the surface height of the blanket was inputted to the blanket humidity adjusting portion so that the humidifying mechanism and the drying mechanism for the blanket were controlled by the controller to maintain the surface height of the blanket below 10 microns.

After the printing was finished, and all of the prints were checked, it was found that there was almost no unevenness in ink thickness in the entire area and prints having good straightness of pattern were obtained.

When the printing apparatus according to Embodiment 5 and the printing apparatus according to Embodiment 6 were used to manufacture the image forming apparatus according to Embodiment 3 and the image forming apparatus according to Embodiment 4, the same excellent performance as that in Embodiments 3 and 4 could be achieved.

According to the present invention, a printing apparatus in which poor printing is minimized can be realized.

Further, according to the present invention, a method for manufacturing a print substrate in which parts of a desired pattern can be formed on the substrate in a reproducible manner can be provided.

Further, according to the present invention, a method for manufacturing an electron source in which a plurality of electron emitting elements can be formed on the substrate in a reproducible manner can be provided.

Further, according to the present invention, a method for manufacturing an image displaying device in which an image can be displayed with high quality in a reproducible manner can be provided.

Lastly, according to the present invention, a method for manufacturing a print substrate, electron source and image displaying device in which throughput is remarkably improved can be provided.

What is claimed is:

1. An offset printing apparatus comprising:

a blanket for transferring an ink pattern onto a medium to be printed;

detecting means for detecting an amount of ink solvent impregnated into said blanket; and control means for controlling the amount of ink solvent impregnated into said blanket, on the basis of an output from said detecting means.

2. A printing apparatus according to claim 1, wherein said control means comprises means for maintaining the amount of ink solvent impregnated into said blanket within a predetermined range.

3. A printing apparatus according to claim 1, wherein said detecting means comprises means for detecting light reflected from said blanket.

4. A printing apparatus according to claim 1, wherein said detecting means comprises means for measuring a thickness of said blanket.

5. An apparatus for manufacturing a print substrate, said apparatus comprising:

means for forming parts of a desired pattern on the substrate by printing, said forming means comprising a blanket for transferring an ink pattern onto the substrate, and detecting means for detecting an amount of ink solvent impregnated into said blanket; and control means for controlling the amount of ink solvent impregnated into said blanket, on the basis of an output from said detecting means.

6. An apparatus according to claim 5, wherein said control means comprises means for maintaining the amount of ink solvent impregnated into said blanket within a predetermined range.

7. An apparatus according to claim 5, wherein said detecting means comprises means for detecting light reflected from said blanket.

8. An apparatus according to claim 5, wherein said detecting means comprises means for measuring a thickness of said blanket.

9. An apparatus for manufacturing a print substrate, said apparatus comprising:

means for forming conductive members of a desired pattern on the substrate by printing, said forming means comprising a blanket for transferring an ink pattern onto the substrate, and detecting means for detecting an amount of ink solvent impregnated into said blanket; and control means for controlling the amount of ink solvent impregnated into said blanket, on the basis of an output from said detecting means.

10. An apparatus according to claim 9, wherein said control means comprises means for maintaining the amount of ink solvent impregnated into said blanket within a predetermined range.

11. An apparatus according to claim 9, wherein said detecting means comprises means for measuring a thickness of said blanket.

12. An apparatus for manufacturing an electron source, said apparatus comprising:

means for forming on a substrate by printing a plurality of electron emitting elements and wirings for interconnecting the plurality of electron emitting elements, said forming means comprising a blanket for transferring an ink pattern onto the substrate, and detecting means for detecting an amount of ink solvent impregnated into said blanket; and control means for controlling the amount of ink solvent impregnated into said blanket, on the basis of an output from said detecting means.

13. An apparatus according to claim 12, wherein said control means comprises means for maintaining the amount of ink solvent impregnated into said blanket within a predetermined range.

14. An apparatus according to claim 12, wherein said detecting means comprises means for measuring a thickness of said blanket.

15. An apparatus according to claim 12, further comprising means for forming the wirings of the electron source by screen printing.

16. An apparatus for manufacturing an electron source including a plurality of electron emitting elements each having a pair of electrodes and conductive thin film having an electron emitting portion disposed between the pair of electrodes, and wirings for interconnecting the plurality of electron emitting elements on a substrate, said apparatus comprising:

means for forming the pair of electrodes of each of the plurality of electron emitting elements, said forming means comprising a blanket for transferring an ink pattern onto the substrate, and detecting means for detecting an amount of ink solvent impregnated into said blanket; and control means for controlling the amount of ink solvent impregnated into said blanket, on the basis of an output from said detecting means.

17. An apparatus according to claim 16, wherein said control means comprises means for maintaining the amount of ink solvent impregnated into said blanket within a predetermined range.

18. An apparatus according to claim 16, wherein said detecting means comprises means for measuring a thickness of said blanket.

19. An apparatus according to claim 16, further comprising means for forming the wirings of the electron source by screen printing.

20. An apparatus for manufacturing an image displaying device comprising an electron source including a plurality of electron emitting elements and wirings for interconnecting the plurality of electron emitting elements, and a fluorescent body lighted by electrons emitted from the election source on a substrate, said apparatus comprising:

means for forming the electron source, said forming means comprising a blanket for transferring an ink pattern onto the substrate, and detecting means for detecting an amount of ink solvent impregnated into said blanket; and control means for controlling the amount of ink solvent impregnated into said blanket, on the basis of an output from said detecting means.

21. An apparatus according to claim 20, wherein said control means comprises means for maintaining the amount of ink solvent impregnated into said blanket within a predetermined range.

22. An apparatus according to claim 20, wherein said detecting means comprises means for measuring a thickness of said blanket.

23. An apparatus for manufacturing a print substrate, said apparatus comprising:

means for forming conductive members of a desired pattern on the substrate by printing, said forming means comprising a blanket for transferring an ink pattern onto the substrate, and detecting means for detecting an amount of ink solvent impregnated into said blanket, wherein said detecting means comprises means for detecting light reflected from said blanket.

24. An apparatus for manufacturing an electron source, said apparatus comprising:

means for forming on a substrate by printing a plurality of electron emitting elements and wirings for interconnecting the plurality of electron emitting elements, said forming means comprising a blanket for transferring an ink pattern onto the substrate, and detecting means for detecting an amount of ink solvent impregnated into said blanket, wherein said detecting means comprises means for detecting light reflected from said blanket.

25. An apparatus according to claim 24, further comprising means for forming the wirings of the electron source by screen printing.

26. An apparatus for manufacturing an electron source including a plurality of electron emitting elements each having a pair of electrodes and a conductive thin film having an electron emitting portion disposed between the pair of electrodes, and wirings for interconnecting the plurality of electron emitting elements on a substrate, said apparatus comprising:

means for forming the pair of electrodes of each of the plurality of electron emitting elements, said forming means comprising a blanket for transferring an ink pattern onto the substrate, and detecting means for detecting an amount of ink solvent impregnated into said blanket, wherein said detecting means comprises means for detecting light reflected from said blanket.

27. An apparatus according to claim 26, further comprising means for forming the wirings of the electron source by screen printing.

28. An apparatus for manufacturing an image displaying device comprising an electron source including a plurality of electron emitting elements and wirings for interconnecting the plurality of electron emitting elements, and a fluorescent body lighted by electrons emitted from the electron source on a substrate, said apparatus comprising:

means for forming the electron source, said forming means comprising a blanket for transferring an ink pattern onto the substrate, and detecting means for detecting an amount of ink solvent impregnated into said blanket, wherein said detecting means comprises means for detecting light reflected from said blanket.

* * * * *

UNITED STATES PATENT AND TRADEMARK OFFICE

CERTIFICATE OF CORRECTION

PATENT NO. : 6,435,093 B1
DATED : August 20, 2002
INVENTOR(S) : Yamada et al.

It is certified that error appears in the above-identified patent and that said Letters Patent is hereby corrected as shown below:

Column 4,
Line 7, “manner” should read -- manner. --.

Column 7,
Line 48, “quantative” should read -- quantitative --.

Column 15,
Line 28, “election” should read -- electron --.

Signed and Sealed this

Eleventh Day of February, 2003

JAMES E. ROGAN
*Director of the United States Patent and Trademark Office*